US012453429B1

(12) United States Patent
Lin

(10) Patent No.: US 12,453,429 B1
(45) Date of Patent: Oct. 28, 2025

(54) INFLATABLE CUSHION

(71) Applicant: FENG YI OUTDOOR LEISURE EQUIPMENT ENTERPRISE CO., LTD., Taichung (TW)

(72) Inventor: Ping-Ting Lin, Taichung (TW)

(73) Assignee: FENG YI OUTDOOR LEISURE EQUIPMENT ENTERPRISE CO., LTD., Taichung (TW)

( * ) Notice: Subject to any disclaimer, the term of this patent is extended or adjusted under 35 U.S.C. 154(b) by 15 days.

(21) Appl. No.: 18/739,549

(22) Filed: Jun. 11, 2024

(51) Int. Cl.
*A47C 27/08* (2006.01)

(52) U.S. Cl.
CPC ..... *A47C 27/087* (2013.01)

(58) Field of Classification Search
CPC ..... A47C 27/087; A47C 27/128; A47C 27/08; A47C 27/081; A47G 9/08; A47G 9/086; A47G 9/06; A47G 9/062
USPC ..... 5/706
See application file for complete search history.

(56) References Cited

U.S. PATENT DOCUMENTS 2,604,641 A * 7/1952 Reed ..... A47C 27/087 5/710
2009/0265857 A1* 10/2009 Habegger ..... A61G 7/05769 5/709

FOREIGN PATENT DOCUMENTS

CN 201790383 U * 4/2011 ..... A47C 27/087
DE 202020104750 U1 * 8/2020 ..... A47C 27/087

OTHER PUBLICATIONS

Translation CN-201790383-U (Year: 2025).*
Translation DE-202020104750-U1 (Year: 2025).*

* cited by examiner

*Primary Examiner* — J. Todd Newton
(74) *Attorney, Agent, or Firm* — LANWAY IPR SERVICES; Chun-Ming Shih

(57) ABSTRACT

An inflatable cushion includes an upper surface layer, a lower surface layer located under the upper surface layer, multiple pull straps mounted between the upper surface layer and the lower surface layer, and a thermal insulation module mounted between the upper surface layer and the lower surface layer. The pull straps are adhered to the upper surface layer and the lower surface layer, so that the inflatable cushion has an interior formed with multiple air passages defined between the upper surface layer, the lower surface layer, and the pull straps. The thermal insulation module includes an upper thermal insulating layer arranged between the upper surface layer and the pull straps, a lower thermal insulating layer arranged between the lower surface layer and the pull straps, and multiple middle thermal insulating layers received in the air passages.

8 Claims, 8 Drawing Sheets

INFLATABLE CUSHION

BACKGROUND OF THE INVENTION

Field of the Invention

The present invention relates to a cushion or mattress and, more particularly, to an inflatable cushion.

Description of the Related Art

A conventional inflatable cushion 90 in accordance with the prior art shown in FIGS. 8 and 9 comprises an upper surface layer 91, a lower surface layer 92, multiple pull straps 93, and an air valve 95. The pull straps 93 are mounted between the upper surface layer 91 and the lower surface layer 92. Each of the pull straps 93 has an upper adhesive section 931 adhered to the upper surface layer 91 and a lower adhesive section 932 adhered to the lower surface layer 92, so that multiple air passages 94 are defined between the upper surface layer 91, the lower surface layer 92, and the pull straps 93.

In use of the conventional inflatable cushion 90, the air valve 95 is opened so that ambient air is introduced from the air valve 95 and flows through the air passages 94 into the inflatable cushion 90. At this time, the air circulates the air passages 94 so that the inflatable cushion 90 has an elastic feature. Thus, when the inflatable cushion 90 is placed on the ground and used outdoors, the air is full of the inflatable cushion 90, to provide a comfortable sensation to the user when lying on the inflatable cushion 90. However, the conventional inflatable cushion 90 cannot provide a thermal insulating function. A thermal insulating element, such as fluff, cotton wool, synthetic cotton or the like, is packed and filled in the air passages 94 to achieve a thermal insulating effect. However, the thermal insulating element has a light weight and cannot be fixed in the air passages 94 so that the thermal insulating element is easily displaced in the air passages 94 and cannot be distributed evenly, thereby decreasing the thermal insulating effect.

BRIEF SUMMARY OF THE INVENTION

The primary objective of the present invention is to provide an inflatable cushion having multiple thermal insulating layers to provide the optimum thermal insulation effect.

In accordance with the present invention, there is provided an inflatable cushion comprising an upper surface layer, a lower surface layer located under the upper surface layer, multiple pull straps mounted between the upper surface layer and the lower surface layer, and a thermal insulation module mounted between the upper surface layer and the lower surface layer. The pull straps are arranged side by side. Each of the pull straps has an upper end provided with an upper adhesive section and a lower end provided with a lower adhesive section. The upper adhesive section of each of the pull straps is adhered to the upper surface layer and form multiple upper adhesive parts. The lower adhesive section of each of the pull straps is adhered to the lower surface layer and form multiple lower adhesive parts. The pull straps are adhered to the upper surface layer and the lower surface layer, so that the inflatable cushion has an interior formed with multiple air passages defined between the upper surface layer, the lower surface layer, and the pull straps. The thermal insulation module includes an upper thermal insulating layer arranged between the upper surface layer and the upper adhesive section of each of the pull straps, a lower thermal insulating layer arranged between the lower surface layer and the lower adhesive section of each of the pull straps, and multiple middle thermal insulating layers received in the air passages of the inflatable cushion. Each of the middle thermal insulating layers includes multiple thermal insulating elements stacked from top to bottom. Each of the thermal insulating elements of each of the middle thermal insulating layers has a tubular shape. Each of the middle thermal insulating layers has an upper connecting section adhered to a lower surface of the upper thermal insulating layer and a lower connecting section adhered to an upper surface of the lower thermal insulating layer.

BRIEF DESCRIPTION OF THE SEVERAL VIEWS OF THE DRAWING(S)

DETAILED DESCRIPTION OF THE INVENTION

Figure 1:
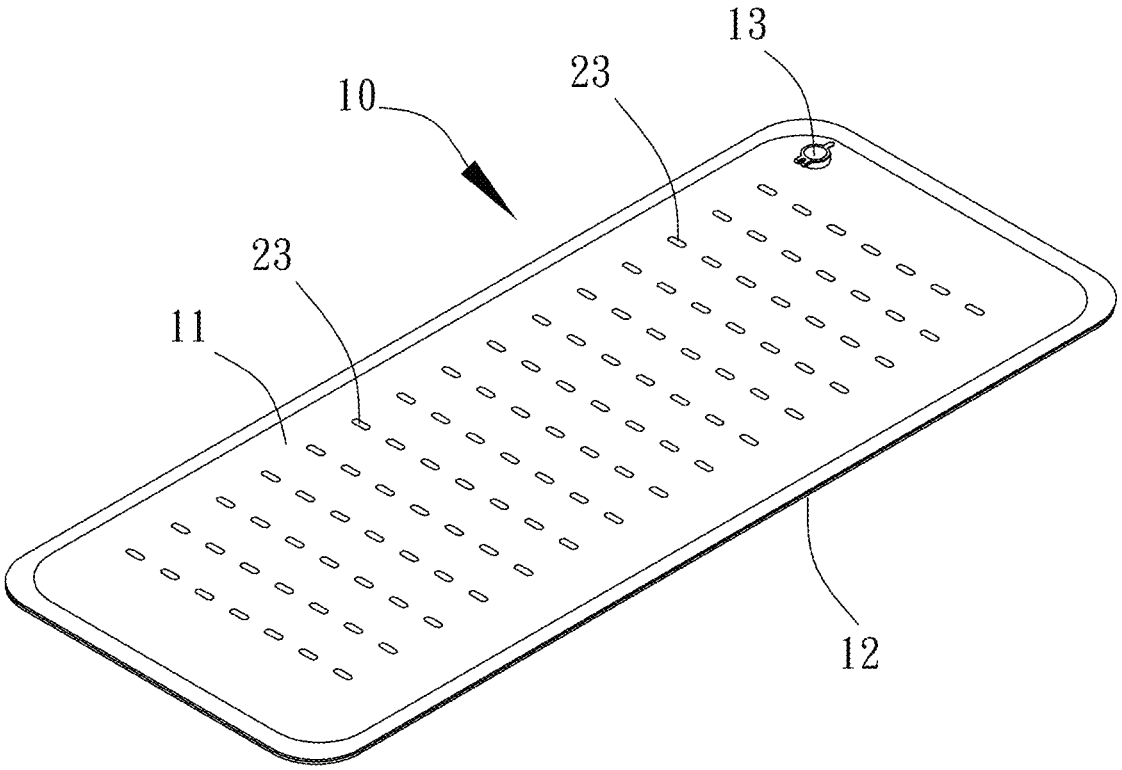
FIG. 1 is a perspective view of an inflatable cushion in accordance with the preferred embodiment of the present invention.
Figure 2:
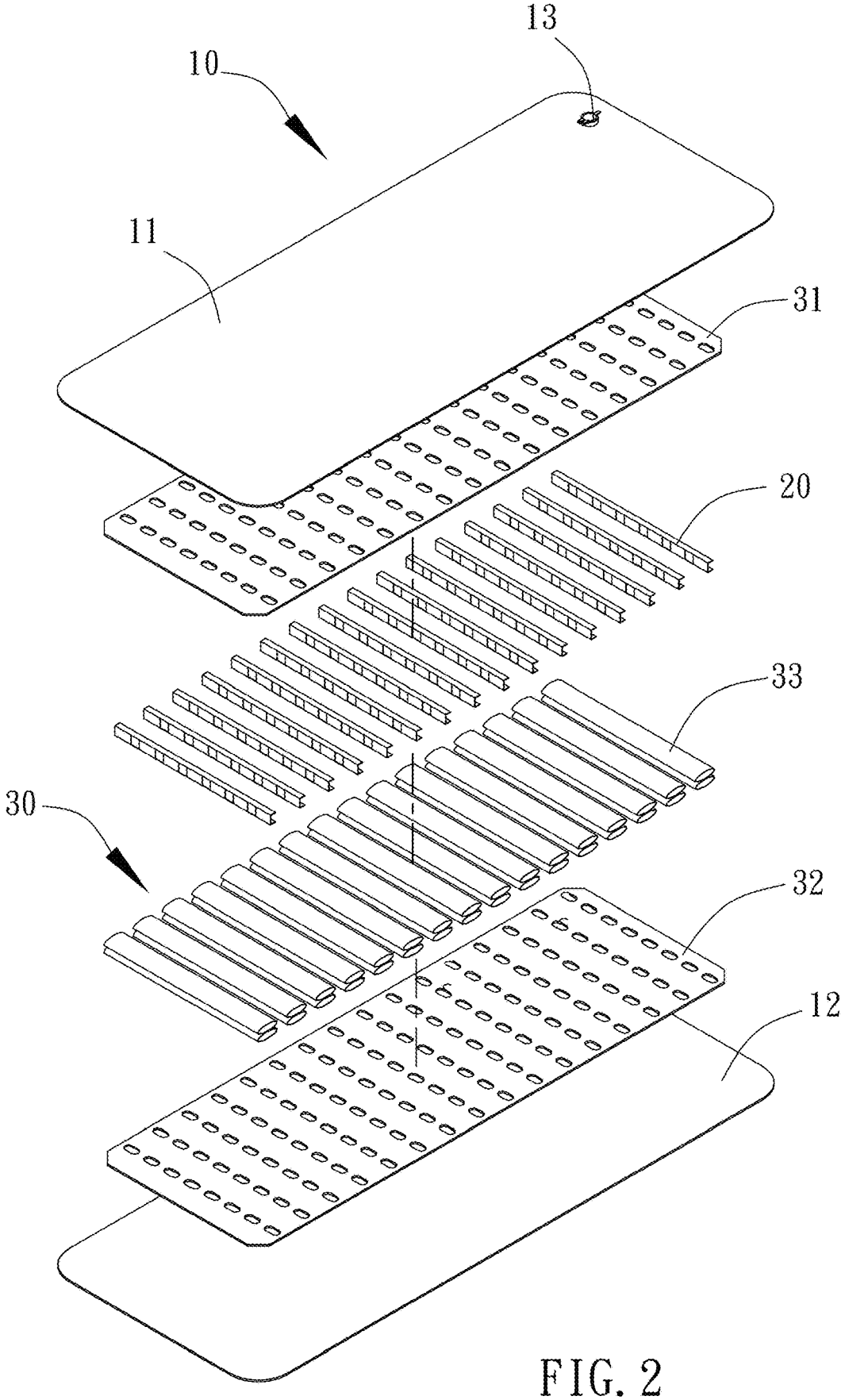
FIG. 2 is an exploded perspective view of the inflatable cushion in accordance with the preferred embodiment of the present invention.
Figure 3:
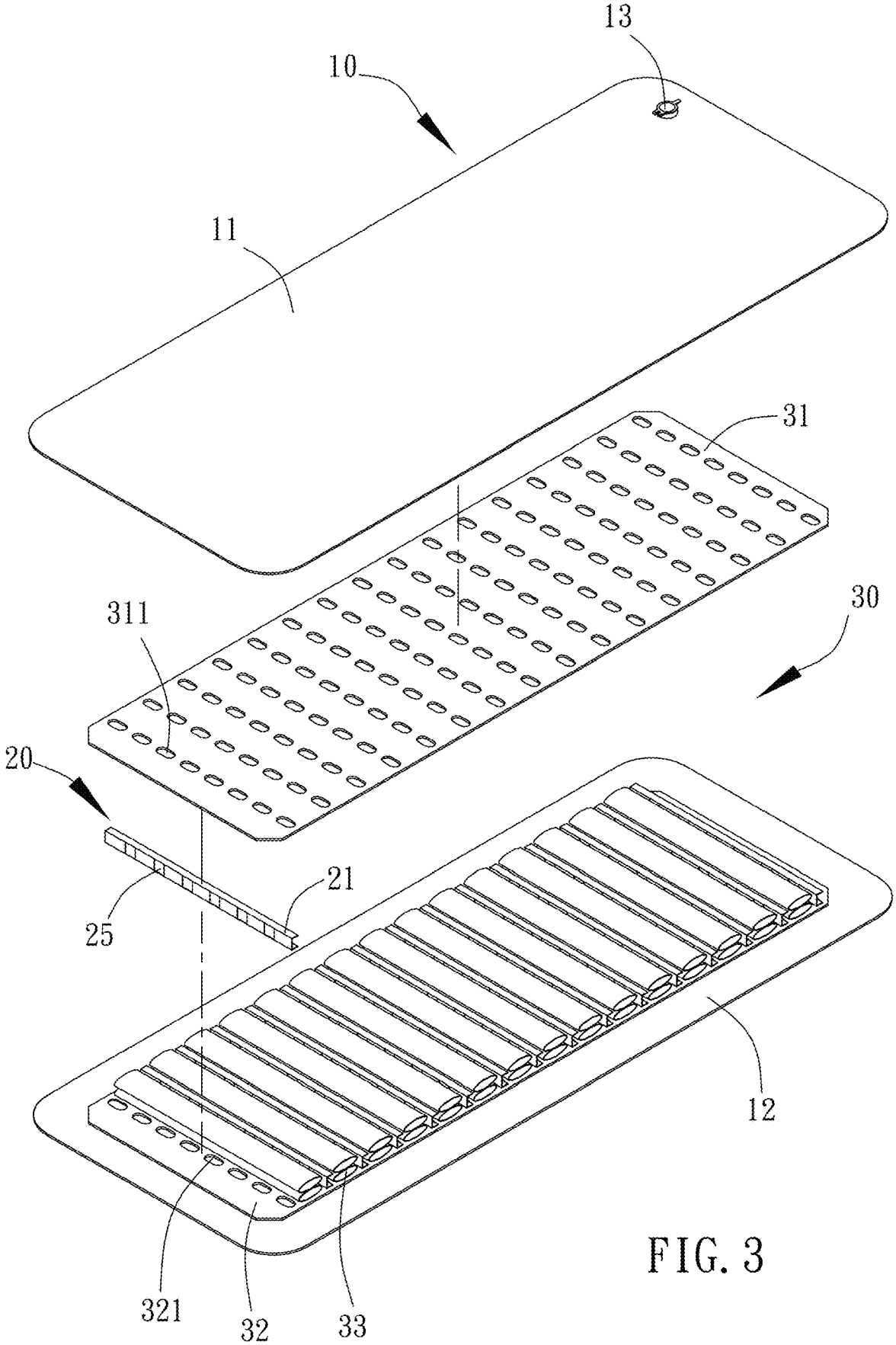
FIG. 3 is a partial exploded perspective view of the inflatable cushion in accordance with the preferred embodiment of the present invention.
Figure 4:
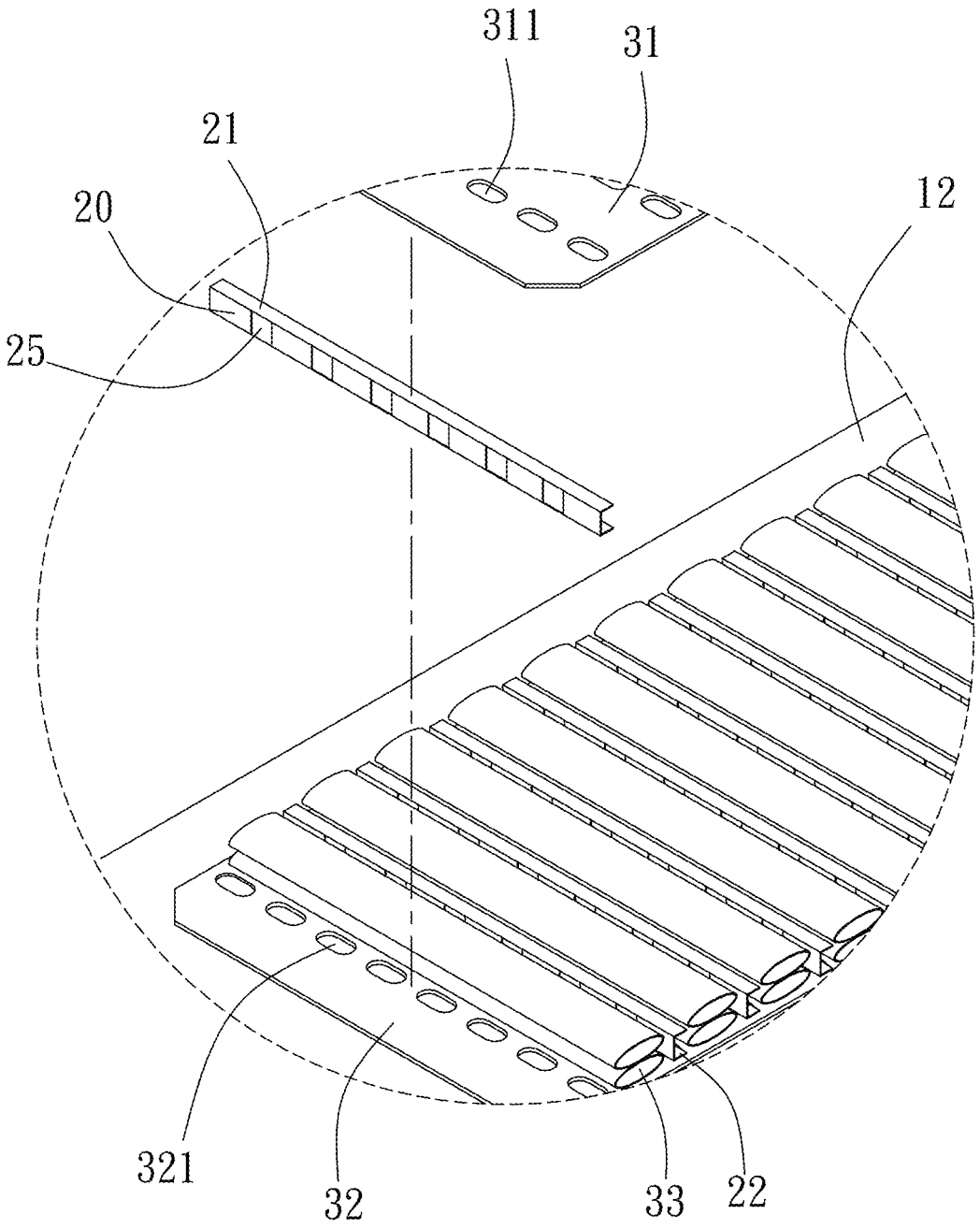
FIG. 4 is a locally enlarged view of the inflatable cushion as shown in FIG. 3.
Figure 5:
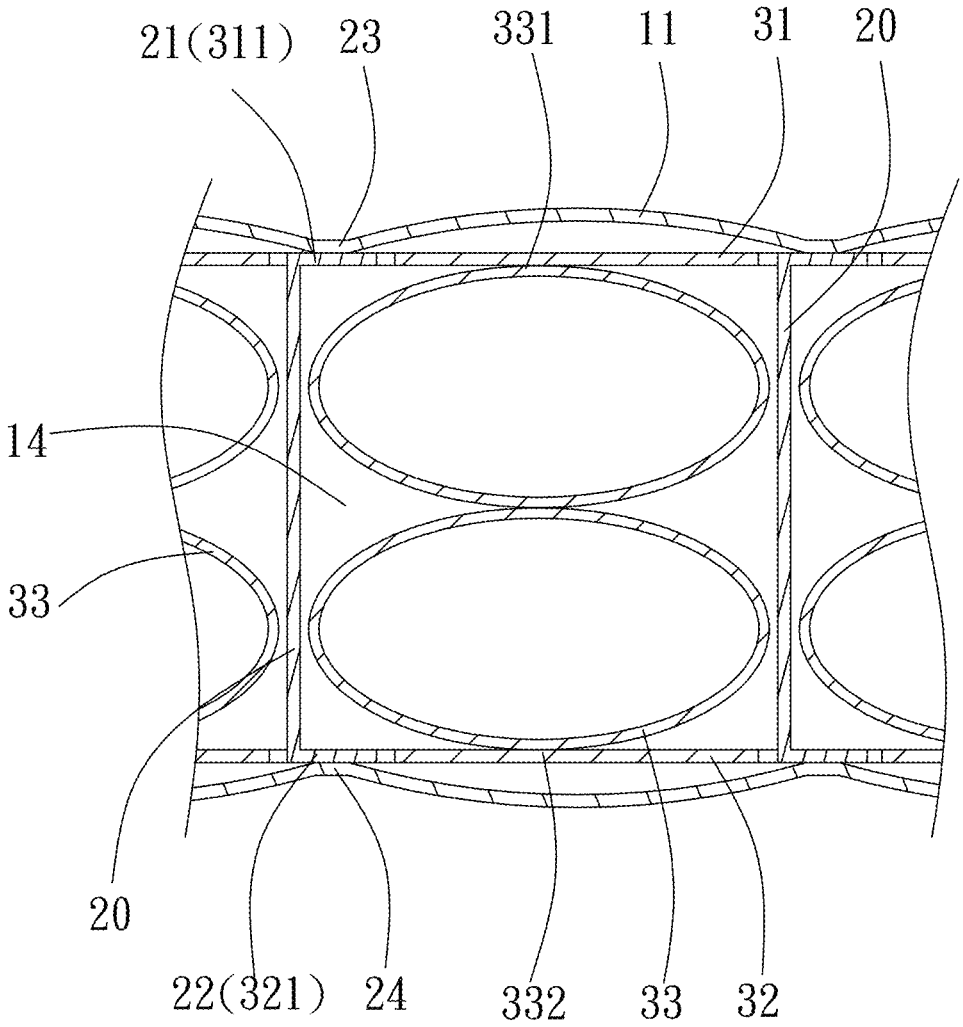
FIG. 5 is a locally enlarged cross-sectional view of the inflatable cushion in accordance with the preferred embodiment of the present invention.

Referring to the drawings and initially to FIGS. 1-5, an inflatable cushion 10 in accordance with the preferred embodiment of the present invention comprises an upper surface layer 11, an air valve 13 mounted on the upper surface layer 11, an upper coating (or adhesive film) layer coated on and adhered to a bottom of the upper surface layer 11, a lower surface layer 12 located under the upper surface layer 11, a lower coating (or adhesive film) layer coated on and adhered a top of the lower surface layer 12, multiple pull straps 20 mounted between the upper surface layer 11 and the lower surface layer 12, and a thermal insulation (or heat preservation) module 30 mounted between the upper surface layer 11 and the lower surface layer 12.

The upper coating layer is made of air-tight (or air-impermeable) material, such as TPU that can be fused. The lower coating layer is made of air-tight (or air-impermeable) material, such as TPU that can be fused. Peripheral portions of the upper surface layer 11, the lower surface layer 12, the upper coating layer, and the lower coating layer are sealed and fused.

Each of the pull straps 20 is made of TPU or other plastic material. The pull straps 20 are arranged side by side or juxtaposed to each other. Each of the pull straps 20 has an upper end provided with an upper adhesive section 21 and a lower end provided with a lower adhesive section 22. The upper adhesive section 21 of each of the pull straps 20 is adhered to the upper surface layer 11 (or the upper coating layer) and form multiple upper adhesive parts 23. The lower adhesive section 22 of each of the pull straps 20 is adhered to the lower surface layer 12 (or the lower coating layer) and form multiple lower adhesive parts 24. The pull straps 20 are adhered to the upper surface layer 11 and the lower surface layer 12, so that the inflatable cushion 10 has an interior formed with multiple air passages (or channels) 14 defined between the upper surface layer 11, the lower surface layer 12, and the pull straps 20.

The thermal insulation module 30 includes an upper thermal insulating layer 31 arranged between the upper surface layer 11 and the upper adhesive section 21 of each of the pull straps 20, a lower thermal insulating layer 32 arranged between the lower surface layer 12 and the lower adhesive section 22 of each of the pull straps 20, and multiple middle thermal insulating layers 33 received in the air passages 14 of the inflatable cushion 10.

Each of the middle thermal insulating layers 33 includes multiple thermal insulating elements stacked from top to bottom. Each of the thermal insulating elements of each of the middle thermal insulating layers 33 has a tubular shape. Each of the middle thermal insulating layers 33 has an upper connecting section 331 adhered to a lower surface of the upper thermal insulating layer 31 and a lower connecting section 332 adhered to an upper surface of the lower thermal insulating layer 32.

In the preferred embodiment of the present invention, the upper thermal insulating layer 31 is provided with multiple upper through holes 311 aligning with the upper adhesive parts 23, and the lower thermal insulating layer 32 is provided with multiple lower through holes 321 aligning with the lower adhesive parts 24.

In the preferred embodiment of the present invention, the upper adhesive section 21 of each of the pull straps 20 is adhered to the upper surface layer 11 in a point-to-point manner and form the upper adhesive parts 23, and the lower adhesive section 22 of each of the pull straps 20 is adhered to the lower surface layer 12 in a point-to-point manner and form the lower adhesive parts 24.

In the preferred embodiment of the present invention, the thermal insulation module 30 is made of a thermal insulating cotton, an aluminum foil of electroplated aluminum plastic material, a non-woven fabric or soft thermal insulating material that can absorb a heat source or radiate and reflect a heat energy.

In the preferred embodiment of the present invention, each of the upper through holes 311 of the upper thermal insulating layer 31 has an inner diameter more than a maximum outer diameter of each of the upper adhesive parts 23, and each of the lower through holes 321 of the lower thermal insulating layer 32 has an inner diameter more than a maximum outer diameter of each of the lower adhesive parts 24.

In the preferred embodiment of the present invention, the upper through holes 311 have a number equal to that of the upper adhesive parts 23, and the lower through holes 321 have a number equal to that of the lower adhesive parts 24.

In the preferred embodiment of the present invention, each of the middle thermal insulating layers 33 includes two thermal insulating elements bonded together from top to bottom.

In the preferred embodiment of the present invention, each of the middle thermal insulating layers 33 includes more than two thermal insulating elements bonded together from top to bottom.

In the preferred embodiment of the present invention, each of the pull straps 20 is provided with multiple slots 25 arranged between the upper adhesive section 21 and the lower adhesive section 22.

In the preferred embodiment of the present invention, the upper through holes 311 of the upper thermal insulating layer 31, the pull straps 20, the middle thermal insulating layers 33, and each of the lower through holes 321 of the lower thermal insulating layer 32 extend transversely.

In assembly, the upper adhesive section 21 of each of the pull straps 20 is adhered to the upper coating layer of the upper surface layer 11, and the lower adhesive section 22 of each of the pull straps 20 is adhered to the lower coating layer of the lower surface layer 12. The upper thermal insulating layer 31 is disposed under the upper surface layer 11, and the lower thermal insulating layer 32 is disposed above the lower surface layer 12. The upper adhesive section 21 of each of the pull straps 20 is disposed under the upper thermal insulating layer 31, and the lower adhesive section 22 of each of the pull straps 20 is disposed above the lower thermal insulating layer 32. Then, by using a welding (or fusing) machine, the upper adhesive section 21 of each of the pull straps 20 is welded and adhered to the upper surface layer 11 in a point-to-point manner and form the upper adhesive parts 23, and the lower adhesive section 22 of each of the pull straps 20 is welded and adhered to the lower surface layer 12 in a point-to-point manner and form the lower adhesive parts 24. At this time, the upper adhesive parts 23 of each of the pull straps 20 align with the upper through holes 311 of the upper thermal insulating layer 31, and the lower adhesive parts 24 of each of the pull straps 20 align with the lower through holes 321 of the lower thermal insulating layer 32, so that the upper adhesive section 21 of each of the pull straps 20 is exactly adhered to the upper surface layer 11 without being interfered by the upper thermal insulating layer 31, and the lower adhesive section 22 of each of the pull straps 20 is exactly adhered to the lower surface layer 12 without being interfered by the lower thermal insulating layer 32. Then, the upper connecting section 331 of each of the middle thermal insulating layers 33 is adhered to the lower surface of the upper thermal insulating layer 31, and the lower connecting section 332 of each of the middle thermal insulating layers 33 is adhered to the upper surface of the lower thermal insulating layer 32. Finally, the peripheral portions of the upper surface layer 11, the lower surface layer 12, the upper coating layer, and the lower coating layer are sealed and fused.

In use of the inflatable cushion 10, the air valve 13 is opened so that ambient air is introduced from the air valve 13 and flows through the air passages 14 into the inflatable cushion 10. At this time, the maximum width of each of the pull straps 20 is less than that of the inflatable cushion 10, so that the air is allowed to flow through the periphery of the inflatable cushion 10. In addition, the air also circulates the air passages 14 and the slots 25 of each of the pull straps 20. Thus, the air is full of the inflatable cushion 10 so that inflatable cushion 10 is inflated and expanded. When the inflatable cushion 10 is inflated, the upper adhesive section 21 of each of the pull straps 20 is moved toward the upper surface layer 11, and the lower adhesive section 22 of each of the pull straps 20 is moved toward the lower surface layer 12. At the same time, the upper thermal insulating layer 31 is limited by the pull straps 20 and moved toward the upper surface layer 11, and the lower thermal insulating layer 32 is limited by the pull straps 20 and moved toward the lower surface layer 12, so that the air is full of the middle thermal insulating layers 33.

Thus, when the inflatable cushion 10 is placed on the ground and used outdoors, the air is full of the inflatable cushion 10, to provide a comfortable sensation to the user when lying on the inflatable cushion 10. At this time, when the heat of the human body permeates through the thermal insulation module 30 of the inflatable cushion 10, the thermal insulation module 30 provides the user with multiple layers of air barrier by arrangement of the upper thermal insulating layer 31, the lower thermal insulating layer 32, and the middle thermal insulating layers 33, so that the inflatable cushion 10 achieves an optimum thermal insulation effect.

Figure 6:
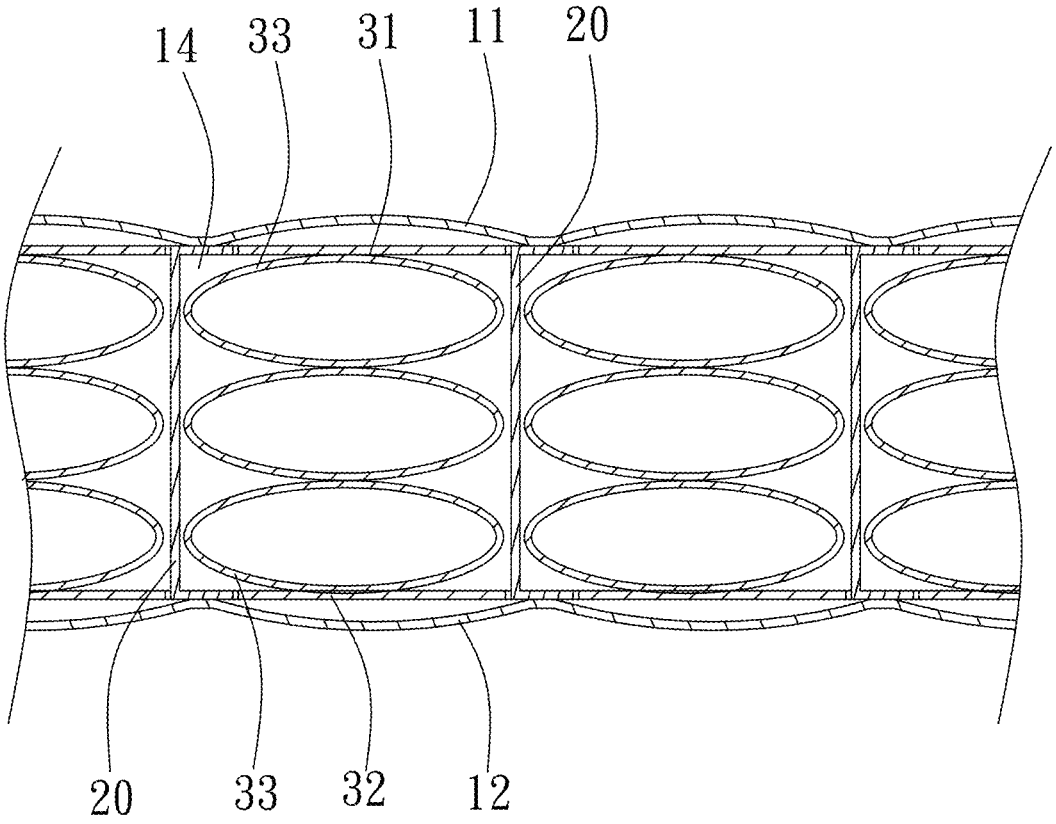
FIG. 6 is a partial cross-sectional view of an inflatable cushion in accordance with the preferred embodiment of the present invention.

Referring to FIG. 6, each of the middle thermal insulating layers 33 includes more than three thermal insulating elements bonded together from top to bottom.

Figure 7:
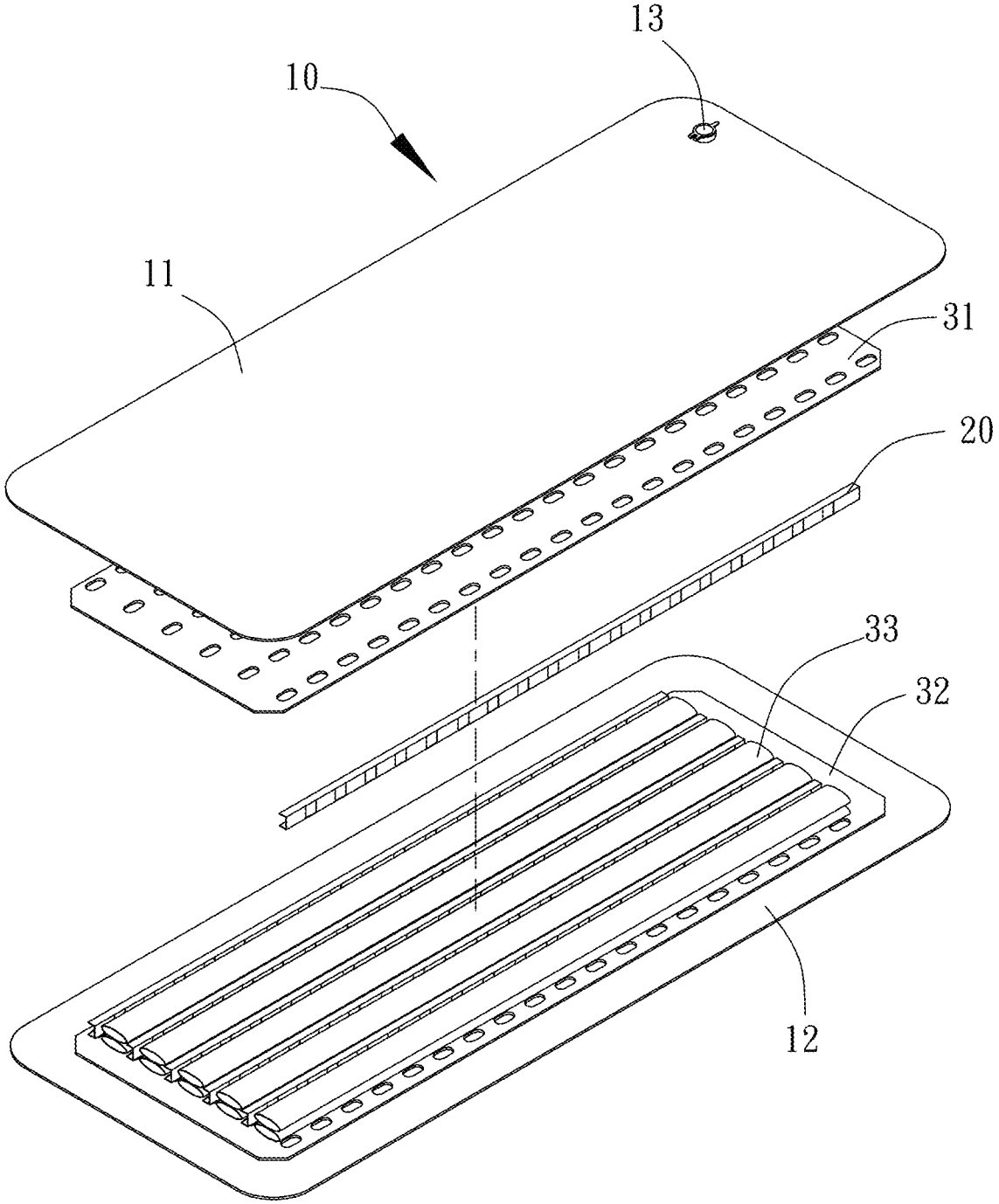
FIG. 7 is a partial exploded perspective view of an inflatable cushion in accordance with another preferred embodiment of the present invention.
Figure 8:
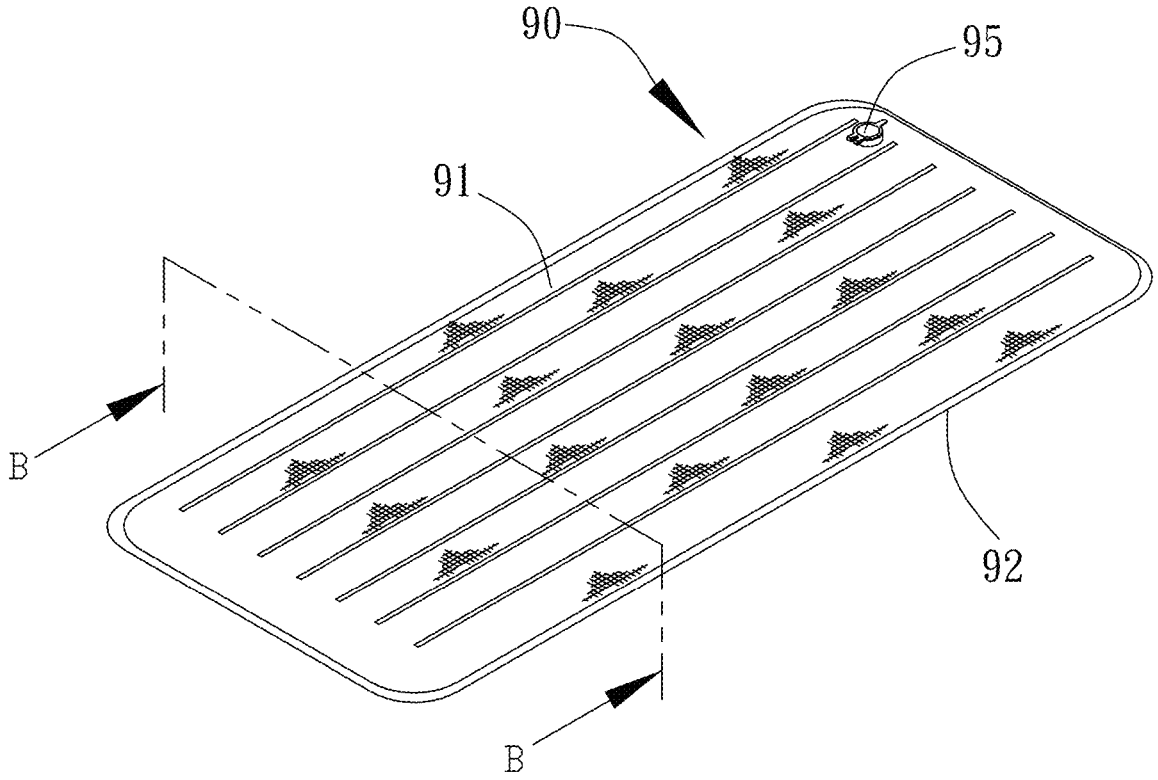
FIG. 8 PRIOR ART
FIG. 8 is a perspective view of a conventional inflatable cushion in accordance with the prior art.
Figure 9:
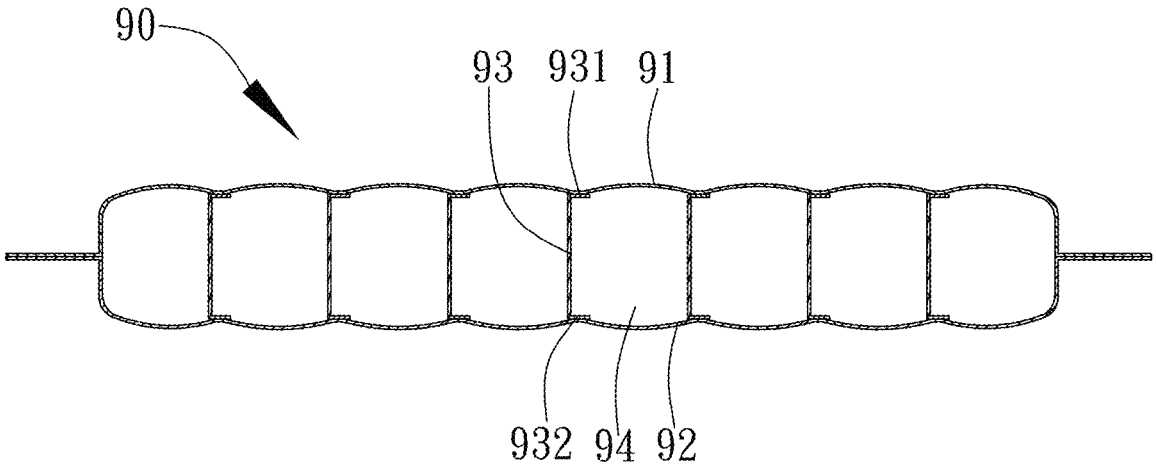
FIG. 9 PRIOR ART
FIG. 9 is a cross-sectional view of the conventional inflatable cushion taken along line B-B as shown in FIG. 8.

Referring to FIG. 7, the upper through holes 311 of the upper thermal insulating layer 31, the pull straps 20, the middle thermal insulating layers 33, and each of the lower through holes 321 of the lower thermal insulating layer 32 extend longitudinally.

Accordingly, the pull straps 20 are mounted between and adhered to the upper surface layer 11 and the lower surface layer 12, the upper thermal insulating layer 31 is arranged between the upper surface layer 11 and the pull straps 20, the lower thermal insulating layer 32 is arranged between the lower surface layer 12 and the pull straps 20, and the middle thermal insulating layers 33 is received in the air passages 14 of the inflatable cushion 10, so that the upper thermal insulating layer 31, the lower thermal insulating layer 32, and the middle thermal insulating layers 33 provide multiple layers of thermal insulation, to enhance the thermal insulation effect of the inflatable cushion 10. In addition, the upper adhesive parts 23 of each of the pull straps 20 align with the upper through holes 311 of the upper thermal insulating layer 31, and the lower adhesive parts 24 of each of the pull straps 20 align with the lower through holes 321 of the lower thermal insulating layer 32, so that the upper adhesive section 21 of each of the pull straps 20 is exactly adhered to the upper surface layer 11 without being interfered by the upper thermal insulating layer 31, and the lower adhesive section 22 of each of the pull straps 20 is exactly adhered to the lower surface layer 12 without being interfered by the lower thermal insulating layer 32. Further, the upper through holes 311 of the upper thermal insulating layer 31 are limited by the upper adhesive parts 23 of each of the pull straps 20, and the lower through holes 321 of the lower thermal insulating layer 32 are limited by the lower adhesive parts 24 of each of the pull straps 20, so that the upper thermal insulating layer 31 and the lower thermal insulating layer 32 will not be moved in the air passages 14 during inflation of the inflatable cushion 10, and the air is inflated smoothly in the air passages 14 of the inflatable cushion 10.

The invention claimed is:

1. An inflatable cushion comprising:

an upper surface layer;

a lower surface layer located under the upper surface layer;

multiple pull straps mounted between the upper surface layer and the lower surface layer; and a thermal insulation module mounted between the upper surface layer and the lower surface layer;

wherein:

the pull straps are arranged side by side;

each of the pull straps has an upper end provided with an upper adhesive section and a lower end provided with a lower adhesive section;

the upper adhesive section of each of the pull straps is adhered to the upper surface layer and form multiple upper adhesive parts;

the lower adhesive section of each of the pull straps is adhered to the lower surface layer and form multiple lower adhesive parts;

the pull straps are adhered to the upper surface layer and the lower surface layer, so that the inflatable cushion has an interior formed with multiple air passages defined between the upper surface layer, the lower surface layer, and the pull straps;

the thermal insulation module includes an upper thermal insulating layer arranged between the upper surface layer and the upper adhesive section of each of the pull straps, a lower thermal insulating layer arranged between the lower surface layer and the lower adhesive section of each of the pull straps, and multiple middle thermal insulating layers received in the air passages of the inflatable cushion;

each of the middle thermal insulating layers includes multiple thermal insulating elements stacked from top to bottom;

each of the thermal insulating elements of each of the middle thermal insulating layers has a tubular shape; and each of the middle thermal insulating layers has an upper connecting section adhered to a lower surface of the upper thermal insulating layer and a lower connecting section adhered to an upper surface of the lower thermal insulating layer.

2. The inflatable cushion as claimed in claim 1, wherein the upper thermal insulating layer is provided with multiple upper through holes aligning with the upper adhesive parts, and the lower thermal insulating layer is provided with multiple lower through holes aligning with the lower adhesive parts.

3. The inflatable cushion as claimed in claim 1, wherein the upper adhesive section of each of the pull straps is adhered to the upper surface layer in a point-to-point manner and form the upper adhesive parts, and the lower adhesive section of each of the pull straps is adhered to the lower surface layer in a point-to-point manner and form the lower adhesive parts.

4. The inflatable cushion as claimed in claim 1, wherein the thermal insulation module is made of a thermal insulating cotton, an aluminum foil of electroplated aluminum plastic material, a non-woven fabric or soft thermal insulating material that can absorb a heat source or radiate and reflect a heat energy.

5. The inflatable cushion as claimed in claim 1, wherein each of the upper through holes of the upper thermal insulating layer has an inner diameter more than a maximum outer diameter of each of the upper adhesive parts, and each of the lower through holes of the lower thermal insulating layer has an inner diameter more than a maximum outer diameter of each of the lower adhesive parts.

6. The inflatable cushion as claimed in claim 1, wherein the upper through holes have a number equal to that of the upper adhesive parts, and the lower through holes have a number equal to that of the lower adhesive parts.

7. The inflatable cushion as claimed in claim 1, wherein each of the middle thermal insulating layers includes two thermal insulating elements bonded together from top to bottom.

8. The inflatable cushion as claimed in claim 1, wherein each of the middle thermal insulating layers includes more than two thermal insulating elements bonded together from top to bottom.

* * * * *